United States Patent [19]

Livak

[11] Patent Number: 4,732,625

[45] **Date of Patent: * Mar. 22, 1988**

[54] COPPER-NICKEL-TIN-COBALT SPINODAL ALLOY

[75] Inventor: Ronald J. Livak, Los Alamos, N. Mex.

[73] Assignee: Pfizer Inc., New York, N.Y.

[ * ] Notice: The portion of the term of this patent subsequent to Jun. 25, 2002 has been disclaimed.

[21] Appl. No.: 759,993

[22] Filed: Jul. 29, 1985

[51] Int. Cl.[4] ..... C22C 9/02

[52] U.S. Cl. ..... 148/433; 148/11.5 C; 148/11.5 P; 148/12.7 C; 148/412; 419/28

[58] Field of Search ..... 148/11.5 C, 11.5 P, 148/12.7 C, 412, 433; 420/473, 496; 419/28

[56] References Cited

U.S. PATENT DOCUMENTS

| | | | |
|---|---|---|---|
| 3,937,638 | 2/1976 | Plewes | 148/12.7 |
| 3,940,290 | 2/1976 | Pryor et al. | 148/2 |
| 3,941,620 | 3/1976 | Pryor et al. | 148/12.7 |
| 3,953,249 | 4/1976 | Pryor et al. | 148/32.5 |
| 4,012,240 | 3/1977 | Hinrichsen et al. | 148/11.5 C |
| 4,052,204 | 10/1977 | Plewes | 75/154 |
| 4,090,890 | 5/1978 | Plewes | 148/12.7 C |
| 4,130,421 | 12/1978 | Plewes et al. | 75/154 |
| 4,142,918 | 3/1979 | Plewes | 148/11.5 C |
| 4,260,432 | 4/1981 | Plewes | 148/2 |
| 4,373,970 | 2/1983 | Scorey et al. | 148/11.5 C |
| 4,406,712 | 9/1983 | Louzon | 148/11.5 C |
| 4,440,572 | 4/1984 | Nadkarni et al. | 75/232 |
| 4,448,852 | 5/1984 | Bose et al. | 428/606 |
| 4,460,658 | 7/1984 | Bose et al. | 428/606 |
| 4,525,325 | 6/1985 | Livak | 420/473 |

FOREIGN PATENT DOCUMENTS

| | | |
|---|---|---|
| 56-5942 | 1/1981 | Japan . |
| 1542181 | 3/1979 | United Kingdom . |

*Primary Examiner*—R. Dean

*Attorney, Agent, or Firm*—Peter C. Richardson; Lawrence C. Akers; Paul H. Ginsburg

[57] ABSTRACT

An age hardened spinodally decomposed alloy prepared by powder metallurgy consisting essentially of from about 5 to about 30 percent by weight nickel, from about 4 to about 13 percent by weight tin, from about 0.5 to about 3.5 percent by weight cobalt and the balance copper exhibits an excellent combination of strength, ductility, formability and electrical conductivity characteristics.

31 Claims, No Drawings

COPPER-NICKEL-TIN-COBALT SPINODAL ALLOY

BACKGROUND OF THE INVENTION

The present invention relates to copper-base spinodal alloys and, in particular, copper-base spinodal alloys also containing nickel and tin.

Ternary copper-nickel-tin spinodal alloys are known in the metallurgical arts. As one example, U.S. Pat. No. 4,373,970 discloses spinodal alloys prepared by powder metallurgy containing from about 5 to 35 weight percent nickel, from about 7 to 13 weight percent tin, and the balance copper. The alloys disclosed by this prior art patent exhibit in the age hardened spinodally decomposed state a highly desirable combination of mechanical and electrical properties, i.e. good strength and good electrical conductivity, and thus have valuable utility as a material of construction for articles of manufacture such as electrical connectors and relay elements. One particular ternary spinodal alloy composition falling within the scope of the disclosure of U.S. Pat. No. 4,373,970 contains about 15 weight percent nickel and about 8 weight percent tin and is sold commercially under the trade name of Pfinodal (Pfizer Inc.; New York, N.Y.). This alloy composition combines a sufficient strength for many commercial applications with a good ductility and an excellent electrical conductivity.

A quaternary spinodal alloy consisting essentially of from about 5 to about 30 percent by weight nickel, from about 4 to about 13 percent by weight tin, from about 3.5 to about 7 percent by weight cobalt and the balance copper, with the sum of the nickel and cobalt contents being no more than 35 percent by weight of the alloy, is disclosed in my U.S. Pat. No. 4,525,325. This alloy exhibits improved ductility, formability and electrical conductivity in the age hardened spinodally decomposed state without substantial diminishment of strength properties in that state, all as compared to a ternary Cu-Ni-Sn alloy in which the nickel content equals the sum of the nickel and cobalt contents in the quarternary alloy. Said U.S. Pat. No. 4,525,325 is incorporated herein by reference in its entirety.

Other copper base spinodal alloys containing nickel and tin are disclosed in U.S. Pat. Nos. 3,937,638; 4,012,240; 4,090,890; 4,130,421; 4,142,918; 4,260,432 and 4,406,712, and U.S. Pat. Re. No. 31,180 (a reissue of U.S. Pat. No. 4,052,204). Of particular interest is U.S. Pat. No. 4,130,421 which discloses the presence of up to 0.2 percent cobalt in a quaternary spinodal copper-nickel-tin-(Se, Te, Pb or MnS) alloy. According to this prior art patent, however, cobalt is not a desired additive and the 0.2 percent level is said to be a preferred upper limit placed on cobalt as an impurity.

Quaternary copper-nickel-tin-cobalt alloys are disclosed in U.S. Pat. No. 3,940,290 and 3,953,249. These alloys contain only 1.5% to 3.3% tin and thus do not appear to be spinodal alloys. Furthermore, these prior art patents teach that the cobalt level in the alloy should not exceed 3% in order to minimize impairment of ductility and hot workability.

Japanese Published patent application No. 5942/81 (published Jan. 22, 1981) discloses a series of cast copper-base quaternary spinodal alloys containing 9 wt. % nickel and 6 wt. % tin including, inter alia, alloys containing 0.5, 0.8 and 2.0 wt. % cobalt, respectively, as the quaternary element.

SUMMARY OF THE INVENTION

The present invention comprises a novel copper base spinodal alloy prepared by powder metallurgy consisting essentially of from about 5 to about 30 percent by weight nickel, from about 4 to about 13 percent by weight tin, from 0.5 to about 3.5 percent by weight cobalt and the balance copper. The alloy affords an excellent combination of strength, ductility, formability (e.g. bendability) and electrical conductivity properties and has an unaged microstructure characterized by an equiaxed grain structure of substantially all alpha, face-centered-cubic phase with a substantially uniform dispersed concentration of tin and a substantial absence of tin segregation.

Of particular interest are (1) an alloy of the invention wherein the cobalt content is from about 1.5 to about 3.5 percent by weight, and (2) an alloy of the invention wherein the tin content is from about 6 to about 8.5 percent by weight.

The present invention also comprises a particular powder metallurgical process for preparing the novel alloy of the invention.

As used herein the term "spinodal alloy" refers to an alloy whose chemical composition is such that it is capable of undergoing spinodal decomposition. An alloy that has already undergone spinodal decomposition is referred to as an "age hardened spinodally decomposed alloy", a "spinodal hardened alloy", or the like. Thus, the term "spinodal alloy" refers to alloy chemistry rather than alloy physical state and a "spinodal alloy" may or may not be at any particular time in an "age hardened spinodally decomposed" state.

The spinodal alloy of the present invention consists essentially of copper, nickel, tin and cobalt. The alloy may optionally contain small amounts of additional elements as desired, e.g. iron, magnesium, manganese, molybdenum, niobium, tantalum, vanadium, aluminum, chromium, silicon, zinc and zirconium, as long as the basic and novel characteristics of the alloy are not materially affected in an adverse manner thereby.

DETAILED DESCRIPTION OF THE INVENTION

The spinodal decomposition of the alloy of the present invention is an age hardening operation carried out for at least about 15 seconds at a temperature of from about 500° F. to about 1000° F. In any particular case the upper limit of this temperature range is primarily established by the chemical composition of the alloy while the lower limit of the range is primarily established by the nature and extent of working of the alloy performed immediately prior to the age hardening. Spinodal decomposition is characterized by the formation of a two-phase alloy microstructure in which the second phase is finely dispersed throughout the first phase.

The spinodal alloy of the present invention may be prepared by a variety of techniques involving the sintering of a body of compacted alloy powder (i.e. powder metallurgy). A particularly preferred powder metallurgical process for preparing an alloy of the present invention is the one set forth (for the Cu-Ni-Sn ternary system) in U.S. Pat. No. 4,373,970. Reference is made to that patent and to U.S. Pat. No. 4,525,325 (including Examples 1 to 6 therein) for a detailed description of this process, including guidelines for the proper selection of various operational parameters. It should be pointed out that this process may be readily adapted to prepare an alloy of the present invention in a wide variety of three-dimensional forms and not only in the form of a strip.

According to the process of U.S. Pat. No. 4,373,970, as adapted to prepare the quaternary alloy of the present invention, an alloy powder containing appropriate proportions of copper, nickel, tin and cobalt is compacted to form a green body having structural integrity and sufficient porosity to be penetrated by a reducing atmosphere, and preferably, a compacted density of from about 70 to 95 percent of the theoretical density, the green body is sintered, preferably for at least one minute at a temperature of from about 1400° F. to about 1900° F., more preferably from about 1600° F. to about 1700° F., and the sintered body is then cooled at a rate, typically at least about 200° F. per minute until the age hardening temperature range of the alloy has been traversed, such that age hardening and embrittlement are prevented. As used herein, the term "alloy powder" includes both blended elemental powders and prealloyed powders, as well as mixtures thereof. The alloy is then worked to approach the theoretical density (with cold working preferred to hot working), annealed and rapidly quenched. The alloy is preferably annealed for at least about 15 seconds at a temperature of from about 1500° F. to about 1700° F. After annealing it is quenched at a rate, typically at least about 100° F. per second, sufficient to retain substantially all alpha phase. If desired, the sintered alloy body may be cold worked in stages with intermediate anneal and rapid cooling between said stages. Also, the alloy body may be cold worked after the final anneal/cooling and immediately before age hardening in such a manner as to achieve a cross-sectional area reduction of at least about 5 percent, more preferably at least about 15 percent.

The duration of the age hardening spinodal decomposition operation should be carefully selected and controlled. The age hardening process proceeds in sequence through three time periods, i.e., the underaged time range, the peak strength aging time range and, finally, the overaged time range. The duration of these three phases will of course vary as the age hardening temperature is varied, but the same general pattern prevails. The strength properties of the age hardened spinodally decomposed alloy of the present invention are highest in the peak strength aging range and lower in the underaged and overaged ranges, while the ductility of the alloy tends to vary in the opposite manner (i.e. lowest in the peak strength aging range). On the other hand, the electrical conductivity of the alloy tends to continuously increase with the time of age hardening. The optimum age hardening time will depend upon the combination of electrical and mechanical properties sought for the alloy being prepared, but will usually be within the peak strength aging range and often, especially when a high electrical conductivity is of particular importance, within the latter half of that range.

For purposes of definition, the peak strength aging time for a particular alloy at a particular age hardening temperature is that precise time of age hardening at which the yield stress of the spinodal hardened alloy is at its maximum value.

I claim:

1. A copper base spinodal alloy prepared by powder metallurgy consisting essentially of from about 5 to about 30 percent by weight nickel, from about 4 to about 13 percent by weight tin, from about 0.5 to about 3.5 percent by weight cobalt and the balance copper, said alloy having an unaged microstructure characterized by an equiaxed grain structure of substantially all alpha, face-centered-cubic phase with a substantially uniform dispersed concentration of tin and a substantial absence of tin segregation.

2. An age hardened spinodally decomposed alloy of claim 1.

3. An alloy of claim 1 wherein the tin content thereof is at least about 6 percent by weight.

4. An alloy of claim 3 wherein the tin content thereof is from about 6 to about 8.5 percent by weight.

5. An alloy of claim 1 wherein the cobalt content thereof is from about 1.5 to about 3.5 percent by weight.

6. An alloy of claim 4 wherein the cobalt content thereof is from about 1.5 to about 3.5 percent by weight.

7. An alloy of claim 2 that has been cold worked, in such a manner as to achieve a cross-sectional area reduction of at least about 5 percent, immediately prior to age hardening.

8. An age hardened spinodally decomposed alloy of claim 6.

9. An alloy of claim 8 that has been cold worked, in such a manner as to achieve a cross-sectional area reduction of at least about 5 percent, immediately prior to age hardening.

10. An electrical connector comprising the alloy of claim 1.

11. An alloy strip consisting essentially of the alloy of claim 1.

12. An alloy of claim 1 having an unaged microstructure further characterized by a substantial absence of grain boundary precipitation.

13. A process for preparing a copper base spinodal alloy body which comprises:

(a) providing a copper base alloy powder consisting essentially of from about 5 to about 30 percent by weight nickel, from about 4 to about 13 percent by weight tin, from about 0.5 to about 3.5 percent by weight cobalt, and the balance copper;

(b) compacting the alloy powder to form a green body having structural integrity and sufficient porosity to be penetrated by a reducing atmosphere;

(c) sintering the green body in the reducing atmosphere to form a metallurgical bond;

(d) cooling the sintered body at a rate such that age hardening and embrittlement are prevented;

(e) working the sintered body to a substantially fully dense condition; and (f) annealing the worked body and quenching it at a rate sufficient to retain substantially all alpha phase.

14. A process of claim 13 wherein the alloy powder is compacted to at least about twice its original uncompacted density.

15. A process of claim 13 wherein the density of the green body is from about 70 to 95 percent of the theoretical density of said body.

16. A process of claim 13 wherein the sintering is at a temperature of from about 1400° F. to about 1900° F. for at least about one minute.

17. A process of claim 16 wherein the sintering is at a temperature of from about 1600° F. to about 1700° F.

18. A process of claim 13 wherein the sintered body is cooled below the age hardening temperature range of the alloy at a rate of at least about 200° F. per minute.

19. A process of claim 13 wherein the oxygen and carbon contents of the sintered body are each kept to less than about 100 ppm.

20. A process of claim 13 wherein said green body, said sintered body and said alloy body are each in the form of a strip.

21. A process of claim 13 wherein the sintered body is cold worked in said step (e).

22. A process of claim 21 wherein said cold working results in a reduction of at least about 30 percent of cross-sectional area.

23. A process of claim 13 wherein the final anneal is at a temperature of from about 1500° F. to about 1700° F. for at least about 15 seconds, followed by quenching at a rate of at least about 100° F. per second to retain substantially all alpha phase.

24. A process of claim 13 wherein the alloy body is age hardened following the final anneal and quench.

25. A process of claim 24 wherein the age hardening is at a temperature of from about 500° F. to about 1000° F. for at least about 15 seconds.

26. A process of claim 25 wherein the duration of the age hardening treatment is approximately equal to the peak strength aging time of the alloy at the age hardening temperature.

27. A process of claim 24 wherein the alloy body is cold worked to achieve at least about a 5 percent reduction in cross-sectional area after the final anneal and quench but before the age hardening.

28. A process of claim 27 wherein the alloy body is cold worked to achieve at least about a 15 percent reduction in cross-sectional area after the final anneal and quench but before the age hardening.

29. A process of claim 13 wherein said green body, said sintered body, said alloy body and said worked body are each in the form of a strip.

30. A process of claim 24 wherein said green body, said sintered body, said worked body and said alloy body are each in the form of a strip.

31. A process for preparing a copper base spinodal alloy body which comprises:

(a) providing a copper base alloy powder consisting essentially of from about 5 to about 30 percent by weight nickel, from about 4 to about 13 percent by weight tin, from about 0.5 to about 3.5 percent by weight cobalt, and the balance copper;

(b) compacting the alloy powder to form a green body having structural integrity and sufficient porosity to be penetrated by a reducing atmosphere;

(c) sintering the green body in the reducing atmosphere to form a metallurgical bond;

(d) hot working the sintered body to a substantially fully dense condition; and (e) rapidly cooling the hot worked body at a rate sufficient to retain substantially all alpha phase.

* * * * *